US012796825B2

(12) United States Patent
Hu et al.

(10) Patent No.: US 12,796,825 B2
(45) Date of Patent: Nov. 17, 2026

(54) FOLDING SUPPORT AND FOLDING BED

(71) Applicant: NINGHAI SUPERSUN TOURIST GOODS CO., LTD., Ningbo (CN)

(72) Inventors: Junmin Hu, Ningbo (CN); Qingguo Gong, Ningbo (CN)

(73) Assignee: NINGHAI SUPERSUN TOURIST GOODS CO., LTD., Ningbo (CN)

( * ) Notice: Subject to any disclaimer, the term of this patent is extended or adjusted under 35 U.S.C. 154(b) by 0 days.

(21) Appl. No.: 19/305,010

(22) Filed: Aug. 20, 2025

(65) Prior Publication Data

US 2026/0114629 A1 Apr. 30, 2026

(30) Foreign Application Priority Data

Oct. 25, 2024 (CN) ..... 202411497201.7
Apr. 29, 2025 (CN) ..... 202520847848.1

(51) Int. Cl.
*A47C 17/68* (2006.01)
*A47C 17/64* (2006.01)

(52) U.S. Cl.
CPC ..... *A47C 17/68* (2013.01); *A47C 17/645* (2013.01); *A47C 17/64* (2013.01)

(58) Field of Classification Search
CPC ..... A47C 17/64; A47C 17/645; A47C 17/68; A47C 17/86
USPC ..... 5/110, 112, 114
See application file for complete search history.

(56) References Cited

U.S. PATENT DOCUMENTS

| | | | | |
|---|---|---|---|---|
| 8,806,675 | B2 * | 8/2014 | Lah | A47C 19/00 5/116 |
| D744,253 | S * | 12/2015 | Lah | D6/392 |
| D744,269 | S * | 12/2015 | Lah | D6/709.2 |
| 10,888,172 | B2 * | 1/2021 | Xia | A47C 27/081 |
| 11,076,702 | B2 * | 8/2021 | Zhang | A47C 17/645 |
| 11,576,496 | B2 * | 2/2023 | Zhu | A47C 17/66 |
| D1,053,642 | S * | 12/2024 | Wang | D6/709.2 |
| 2014/0115780 | A1 * | 5/2014 | Lah | A47C 19/12 5/111 |
| 2018/0070735 | A1 * | 3/2018 | Xia | A47C 19/122 |
| 2021/0127844 | A1 * | 5/2021 | Zhang | A47C 17/74 |
| 2022/0225782 | A1 * | 7/2022 | Zhu | A47C 17/66 |
| 2026/0114629 | A1 * | 4/2026 | Hu | A47C 17/68 |

* cited by examiner

*Primary Examiner* — Robert G Santos
(74) *Attorney, Agent, or Firm* — COOPER LEGAL GROUP LLC

(57) ABSTRACT

A folding support and a folding bed are provided. The folding support includes a supporting crossbar and a folding assembly arranged at each of two ends of the supporting crossbar. The folding assembly includes a connecting base, an upper supporting rod, and a lower supporting rod. The connecting base is fixedly mounted at an end portion of the supporting crossbar. The upper supporting rod is rotatably connected to the connecting base. The lower supporting rod is rotatably connected to the upper supporting rod. The upper supporting rod and the lower supporting rod are configured to rotate in an identical plane to implement folding and unfolding of the folding assembly. When the folding assembly is folded, the upper supporting rod and the lower supporting rod are folded toward each other, and the upper supporting rod and the lower supporting rod are positioned adjacent to a side of the supporting crossbar.

20 Claims, 13 Drawing Sheets

FOLDING SUPPORT AND FOLDING BED

CROSS REFERENCE TO THE RELATED APPLICATIONS

This application is based upon and claims priority to Chinese Patent Application No. 202411497201.7, filed on Oct. 25, 2024, and Chinese Patent Application No. 202520847848.1, filed on Apr. 29, 2025. The entire contents of Chinese Patent Application No. 202411497201.7 and Chinese Patent Application No. 202520847848.1 are incorporated herein by reference.

TECHNICAL FIELD

The present disclosure relates to the technical field of folding beds, and specifically to a folding support and a folding bed.

BACKGROUND

Folding beds are a type of simple beds designed by using the principle of joints. Folding beds can be folded and stored in a variety of folding ways for convenience and space saving. Due to the advantages such as easy use and portability, folding beds are widely used in many places such as homes, offices, hospitals, and outdoor camping. In homes, folding beds can be used as temporary beds to meet the needs of guests to stay overnight. In offices, folding beds can provide employees with a place to take a lunch break. In hospitals, folding beds can be used for ward care, etc. In outdoor camping, folding beds can provide people with a comfortable resting environment.

However, conventional folding beds have a complex structure, and the steps of unfolding and folding a conventional folding bed are cumbersome. A user needs to lock or unlock multiple rods in sequence, and the entire operation process is time-consuming and laborious. In addition, the stability of conventional folding beds is not sufficiently high after unfolding. As a result, the folding beds are prone to shaking during use. Especially when the user turns over or moves, the conventional folding bed may even overturn.

SUMMARY

An objective of the present disclosure is to provide a folding support which is easy to fold and unfold and has excellent structural stability.

Another objective of the present disclosure is to provide a folding bed.

To achieve the above objectives, the following technical solutions are adopted in the present disclosure. A folding support is provided, including a supporting crossbar and a folding assembly arranged at each of two ends of the supporting crossbar, where the folding assembly includes a connecting base, an upper supporting rod, and a lower supporting rod, the connecting base is fixedly mounted at an end portion of the supporting crossbar, the upper supporting rod is rotatably connected to the connecting base, the lower supporting rod is rotatably connected to the upper supporting rod, and the upper supporting rod and the lower supporting rod are configured to rotate in an identical plane to implement folding and unfolding of the folding assembly;

when the folding assembly is folded, the upper supporting rod and the lower supporting rod are folded toward each other, and the upper supporting rod and the lower supporting rod are positioned adjacent to a side of the supporting crossbar; and when the folding assembly is unfolded, the upper supporting rod and the lower supporting rod are unfolded away from each other, the upper supporting rod and the lower supporting rod abut against the connecting base, and the lower supporting rod is locked and engaged with the connecting base to limit a rotation of the upper supporting rod and the lower supporting rod to allow the folding assembly to maintain in an unfolded state.

In a preferred embodiment, the upper supporting rod includes a hinge end and a mounting end, the hinge end is configured to be rotatably connected to the connecting base, the mounting end is configured to be detachably connected to a bed cloth supporting rod, the lower supporting rod includes a main rod body, and an end of the main rod body is rotatably connected to a middle portion of the upper supporting rod; or the upper supporting rod includes a hinge end and a mounting end, the hinge end is configured to be rotatably connected to the connecting base, the mounting end is configured to be detachably connected to a bed cloth supporting rod, the lower supporting rod includes an extension rod body and a main rod body, a first end of the extension rod body is rotatably connected to a middle portion of the upper supporting rod, and a second end of the extension rod body is rotatably connected to an end portion of the main rod body.

In another preferred embodiment, the connecting base is provided with a hinge groove, an opening of the hinge groove is located on an end surface of the connecting base adjacent to the supporting crossbar, a bottom end of the hinge groove is configured as a closed end, a top end of the hinge groove is configured as an open end in communication with an outside, and the hinge end of the upper supporting rod is rotatably connected to the open end of the hinge groove.

Further preferably, the connecting base includes a first connecting portion and a second connecting portion, the first connecting portion is configured to be connected to the supporting crossbar, the second connecting portion is configured to be connected to the upper supporting rod, the first connecting portion extends in a horizontal direction, the second connecting portion extends in a vertical direction, the first connecting portion and the second connecting portion are arranged perpendicular to each other, the connecting base is in an L-shape, and the hinge groove is arranged on the second connecting portion.

Further, the second connecting portion includes a main support wall and two side support walls located respectively on two sides of the main support wall, the hinge groove is defined by the main support wall and the two side support walls, and when the upper supporting rod is rotated to a maximum unfolded position, the upper supporting rod is configured to abut against a top end of the main support wall, and the main support wall limits a further rotation of the upper supporting rod and supports the upper supporting rod.

Further, the second connecting portion includes a main support wall and two side support walls located respectively on two sides of the main support wall, the hinge groove is defined by the main support wall and the two side support walls, a reinforcing rib is arranged in the hinge groove, and when the upper supporting rod is rotated to a maximum unfolded position, the upper supporting rod is configured to abut against the reinforcing rib, and the reinforcing rib limits a further rotation of the upper supporting rod and supports the upper supporting rod.

Further, a locking push button is movably arranged on the main rod body, a locking pin is arranged on the locking push button, a locking portion is arranged on the connecting base, a locking cavity is defined by the locking portion and the connecting base, and the locking push button is configured to drive the locking pin to slide into the locking cavity to allow the locking pin to be engaged with the locking portion to limit a rotation of the main rod body.

Further, an elastic member is further arranged between the locking push button and the main rod body, the elastic member is configured to apply a force to the locking push button to allow the locking pin to be embedded in the locking cavity, and the locking pin has a tendency to maintain being locked and engaged with the locking portion.

Further, the locking pin has a curved guide surface, the locking portion has an inclined guide surface, and the curved guide surface is configured to come into contact with the inclined guide surface to guide the locking pin to slide into the locking cavity.

Further, a limiting portion is arranged on the connecting base, a limiting groove is provided on the extension rod body, and when the folding assembly is unfolded, the limiting portion abuts against the limiting groove and is engaged with the limiting groove to limit the extension rod body from driving the main rod body to move upward in a vertical direction to allow the locking pin to be disengaged from the locking portion.

Further, the main rod body includes a bottom rod and two side rods, bottom ends of the two side rods are integrally connected to two end portions of the bottom rod, respectively, a top end of each of the two side rods is rotatably connected to the upper supporting rod or the extension rod body, the two side rods are arranged inclined relative to the bottom rod, and the main rod body is in a triangular shape.

Further, each of the two side rods includes a supporting segment adjacent to the bottom rod and a connecting segment away from the bottom rod, the supporting segment is arranged inclined relative to the connecting segment, and when the folding assembly is unfolded, the supporting segment obliquely extends in a direction away from the connecting base.

Further, an angle between the supporting segment and the connecting segment ranges from 165° to 175°.

Further, the mounting end is provided with a bracket, and the bracket is detachably connected to the bed cloth supporting rod.

The present disclosure provides a folding bed including the folding support described above.

Compared with the prior art, the present disclosure has the following advantages.

The lower supporting rod can drive the upper supporting rod to rotate in the same plane relative to the connecting base to unfold or fold the folding assembly. After the folding assembly is unfolded, the lower supporting rod is in contact with the placement plane to support the load. In other words, the lower supporting rod can serve as an "operating handle" and a "supporting leg", and a user can complete the unfolding and folding of the folding assembly by operating the lower supporting rod. As such, the operation steps of unfolding and folding the folding support are simplified, and the structural strength of the folding support is ensured.

DETAILED DESCRIPTION OF THE EMBODIMENTS

Figure 1:
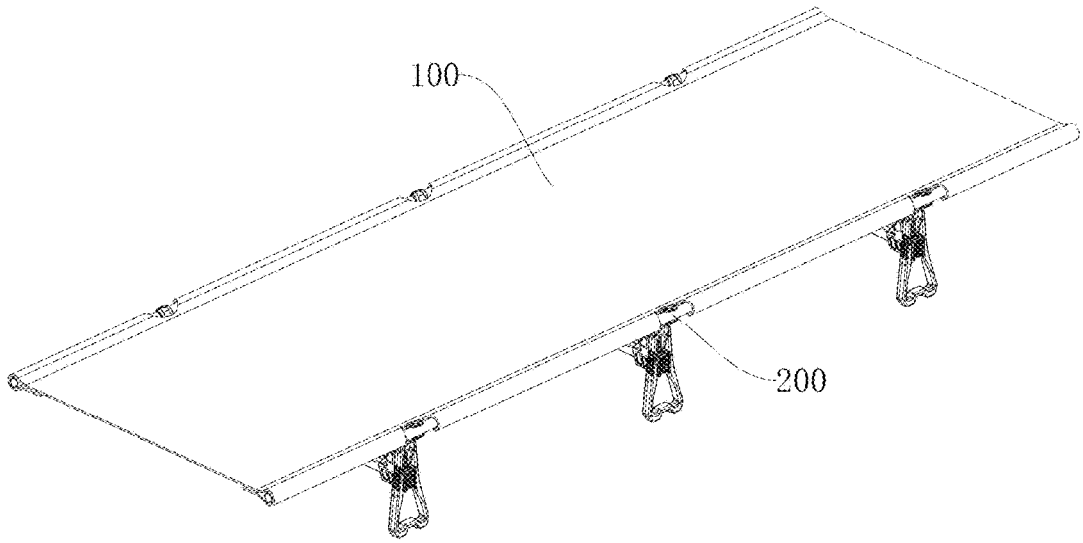
FIG. 1 is a three-dimensional schematic structural diagram of a folding bed according to Embodiment 1 of the present disclosure.

The present disclosure will be further described through specific embodiments. It should be noted that the embodiments or technical features described below may be arbitrarily combined to form new embodiments without conflict.

In the description of the present disclosure, it should be noted that orientation and position relationships indicated by the orientation terms such as "center", "transverse", "longitudinal", "length", "width", "thickness", "on", "below", "front", "rear", "left", "right", "vertical", "horizontal", "top", "bottom", "inner", "outer", "clockwise", and "counterclockwise" are based on the orientation or positional relationships shown in the drawings, and are only for the convenience of describing the present disclosure and simplifying the description, rather than indicating or implying that the apparatus or element described must have a specific orientation or be constructed and operated in a specific orientation, and therefore are not to be construed as limiting the present disclosure.

It should be noted that in the specification and claims of the present disclosure, the terms "first", "second" or the like are intended to distinguish between similar objects but do not indicate a particular order or sequence.

In the specification and claims of the present disclosure, the terms "comprise," "include," and any other variants thereof are intended to cover a non-exclusive inclusion. For example, a process, method, system, product, or device that includes a list of steps or units is not necessarily limited to those expressly listed steps or units, but may include other steps or units not expressly listed or inherent to such a process, method, product, or device.

Embodiment 1

Figure 2:
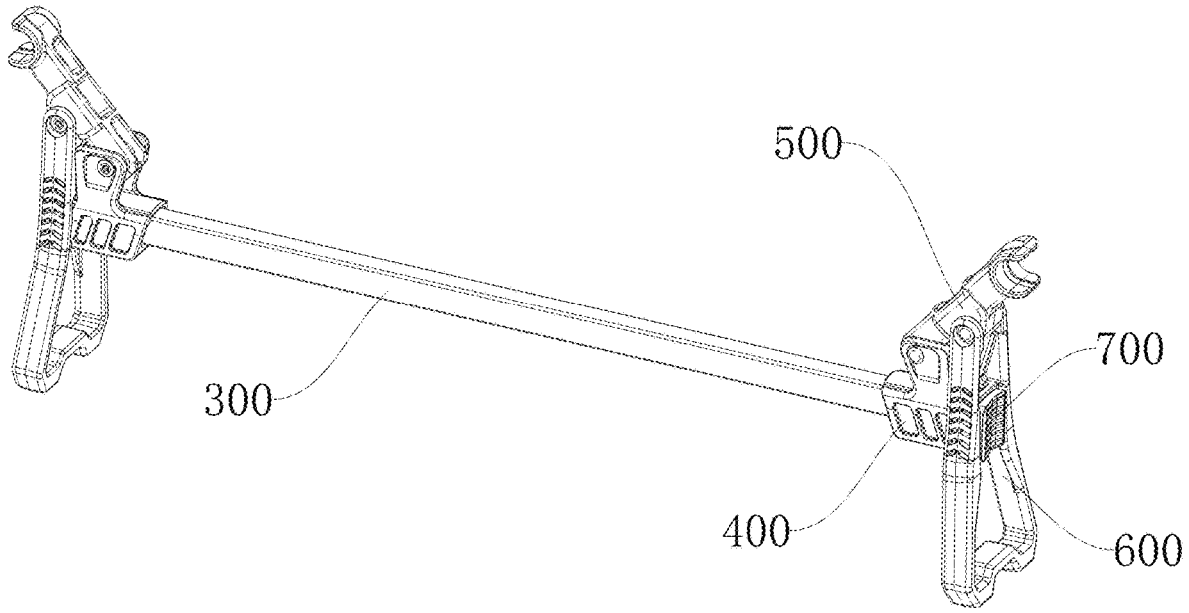
FIG. 2 is a three-dimensional schematic structural diagram of a folding support in an unfolded state according to Embodiment 1 of the present disclosure.
Figure 3:
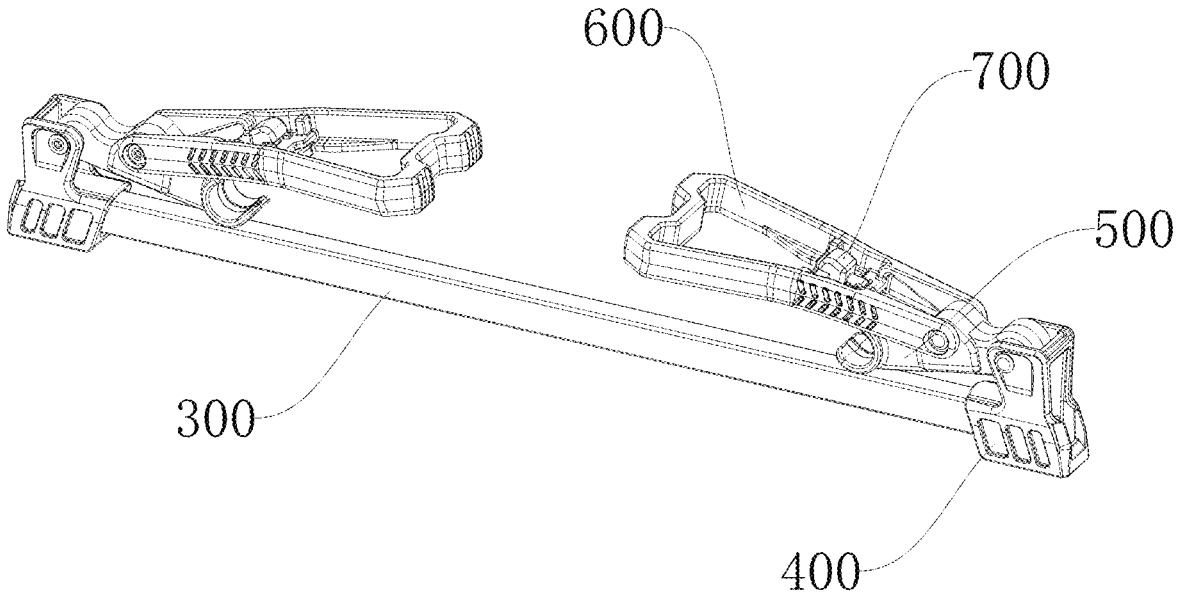
FIG. 3 is a three-dimensional schematic structural diagram of a folding support in a folded state according to Embodiment 1 of the present disclosure.
Figure 4:
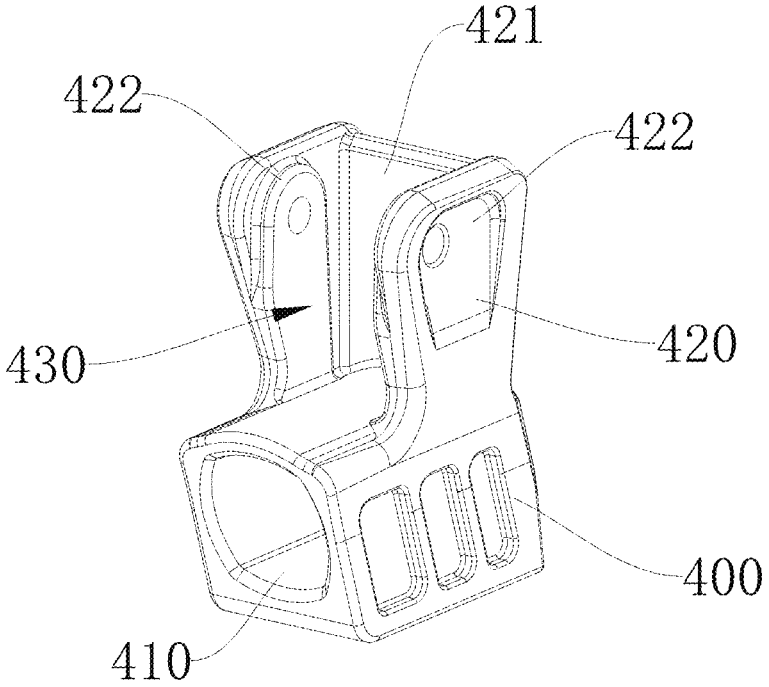
FIG. 4 is a three-dimensional schematic structural diagram of a connecting base according to Embodiment 1 of the present disclosure.
Figure 5:
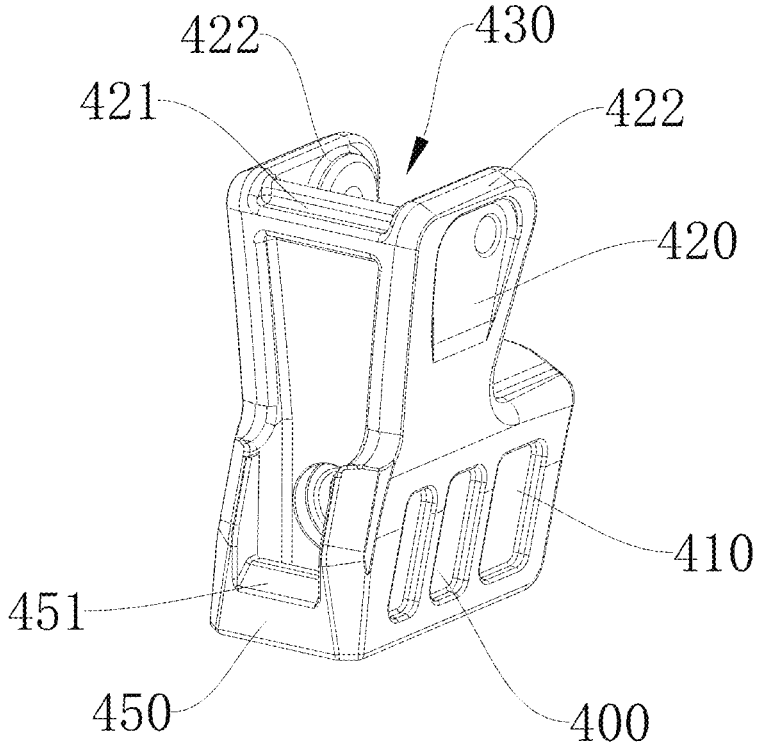
FIG. 5 is a three-dimensional schematic structural diagram of a connecting base according to Embodiment 1 of the present disclosure when viewed from another angle.
Figure 6:
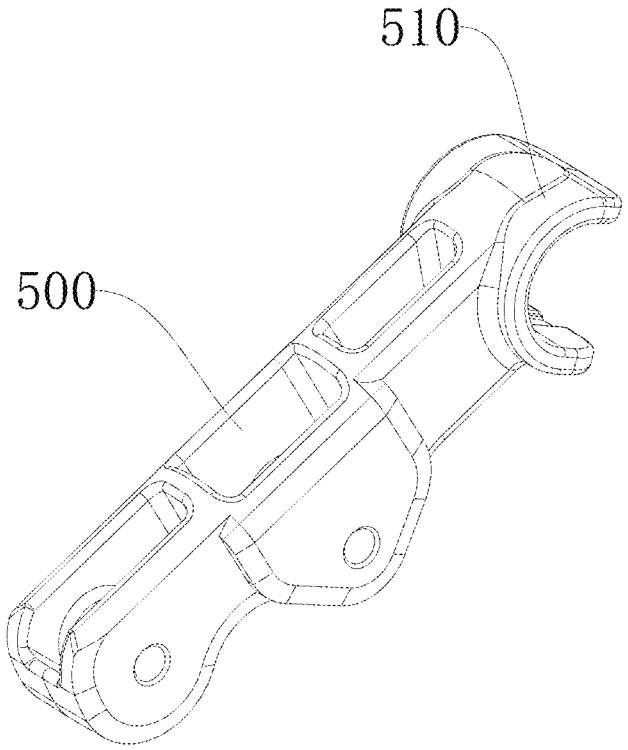
FIG. 6 is a three-dimensional schematic structural diagram of an upper supporting rod according to Embodiment 1 of the present disclosure.
Figure 7:
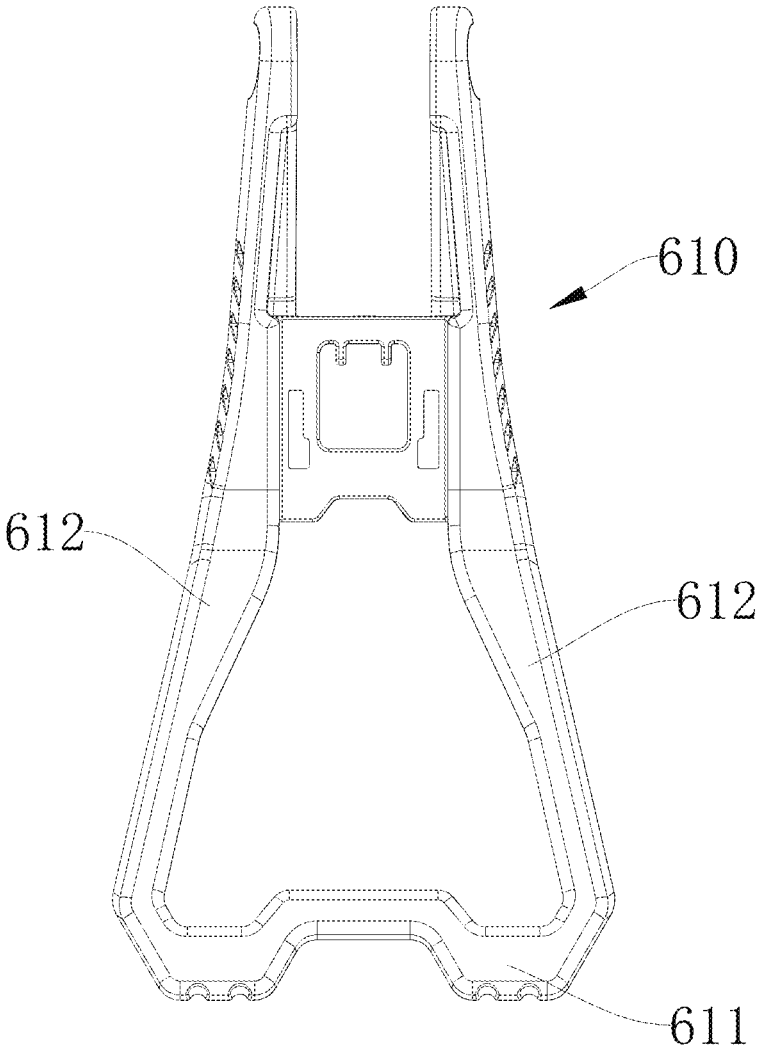
FIG. 7 is a schematic structural diagram of a main rod body according to Embodiment 1 of the present disclosure.
Figure 8:
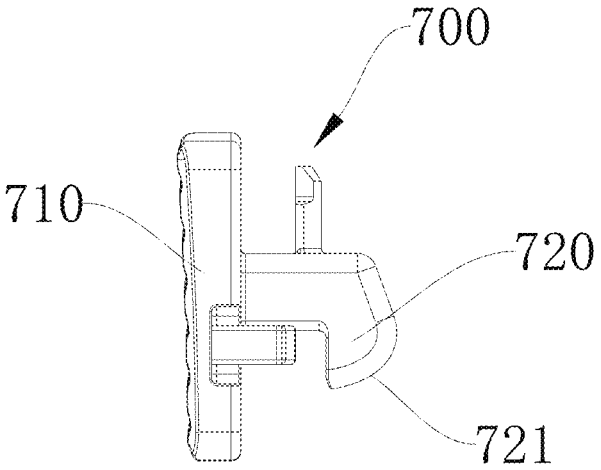
FIG. 8 is a schematic structural diagram of a locking member according to Embodiment 1 of the present disclosure.
Figure 9:
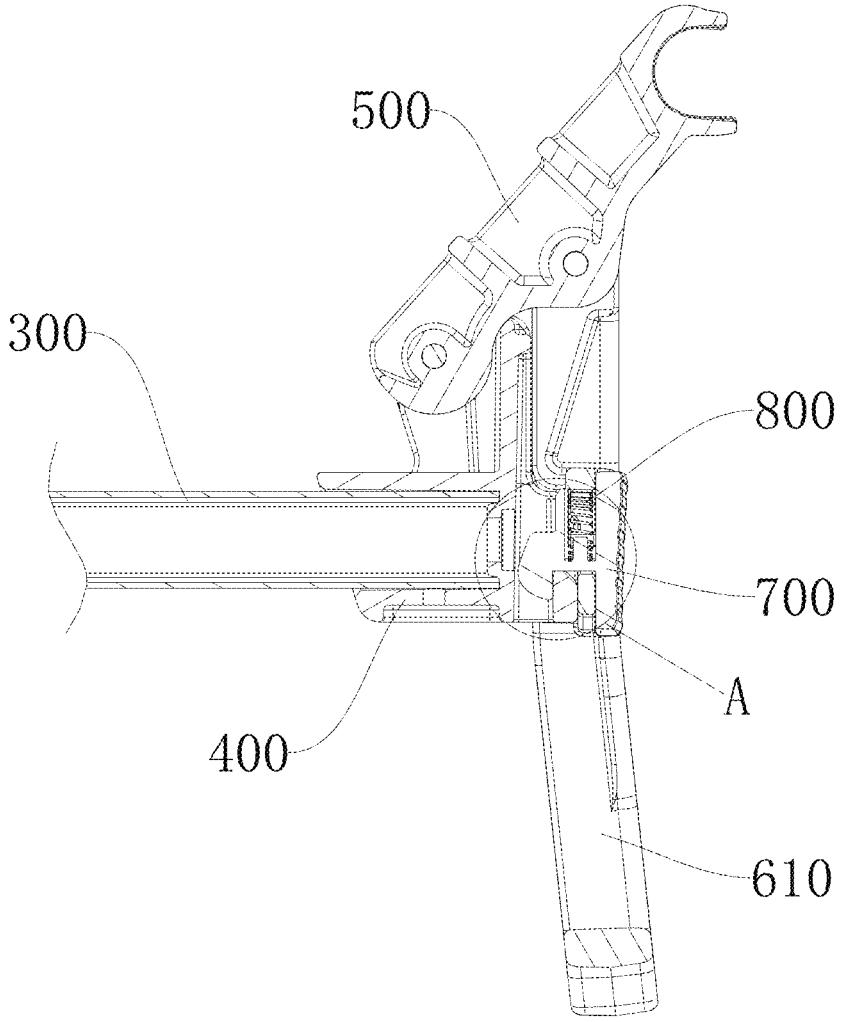
FIG. 9 is a schematic cross-sectional view of a folding assembly in an unfolded state according to Embodiment 1 of the present disclosure.
Figure 10:
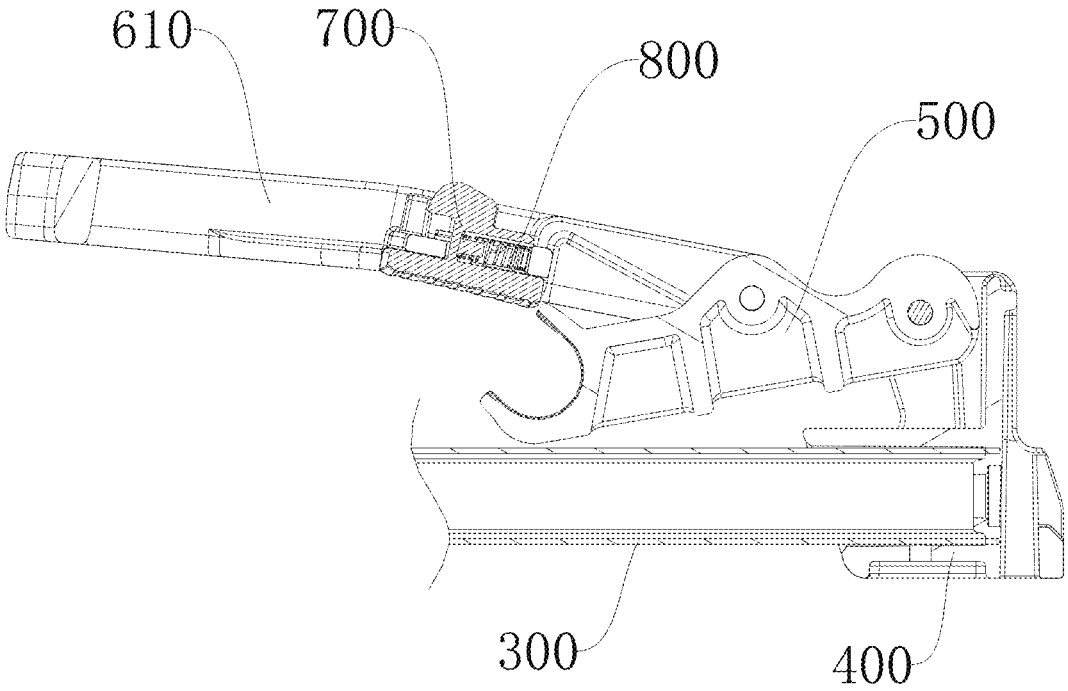
FIG. 10 is a schematic cross-sectional view of a folding assembly in a folded state according to Embodiment 1 of the present disclosure.
Figure 11:
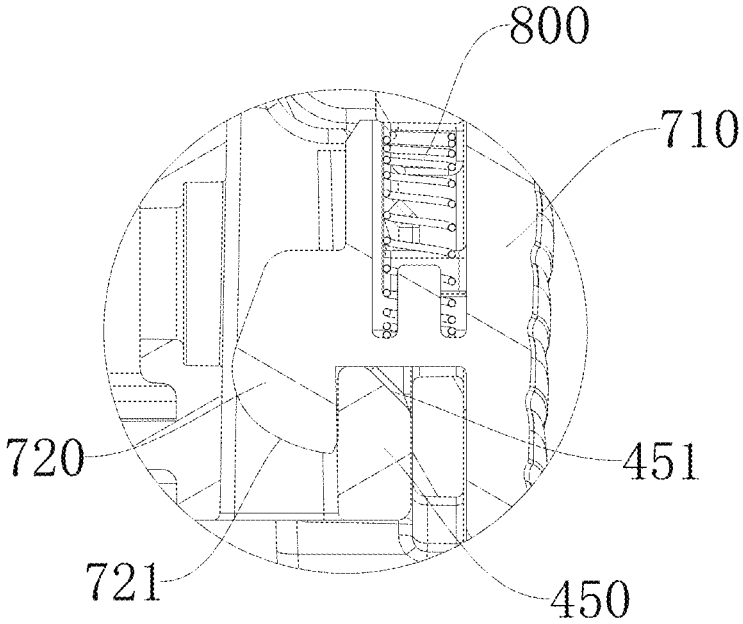
FIG. 11 is a schematic partially enlarged view of part A in FIG. 9.

As shown in FIG. 1 to FIG. 11, this embodiment provides a folding bed, which includes a bed cloth assembly and a plurality of folding supports configured to support the bed cloth assembly.

The bed cloth assembly includes a bed cloth main body 100 and two bed cloth supporting rods 200. The two bed cloth supporting rods 200 are respectively arranged on two sides of the bed cloth main body 100 in a length direction of the bed cloth main body 100.

The plurality of folding supports are arranged at intervals in the length direction of the bed cloth main body 100, and are each configured to be detachably connected to a respective one of the two bed cloth supporting rods 200 to support the bed cloth main body 100, the bed cloth supporting rods 200, and a load on the bed cloth main body 100. Each of the plurality of folding supports includes a supporting crossbar 300 and a folding assembly arranged at each of two ends of the supporting crossbar 300. The folding assembly includes a connecting base 400, an upper supporting rod 500, and a lower supporting rod 600. The connecting base 400 is fixedly connected to an end portion of the supporting crossbar 300. The connecting base 400 is provided with a hinge groove 430. An opening of the hinge groove 430 is located on an end surface of the connecting base 400 adjacent to the supporting crossbar 300. A bottom end of the hinge groove 430 is configured as a closed end. A top end of the hinge groove 430 is configured as an open end in communication with an outside. The upper supporting rod 500 includes a hinge end and a mounting end. The hinge end of the upper supporting rod 500 is configured to be rotatably connected to the open end of the hinge groove 430. The mounting end of the upper supporting rod 500 is configured to be detachably connected to the respective bed cloth supporting rod 200. The mounting end is provided with a bracket 510. The bracket 510 is made of elastic plastic and is provided with an opening. The bed cloth supporting rod 200 is configured to pass through the opening and be detachably engaged in the bracket 510. The lower supporting rod 600 includes a main rod body 610. A first end of the main rod body 610 is rotatably connected to a middle portion of the upper supporting rod 500, and a second end of the main rod body 610 is configured to be supported on a placement plane when the folding assembly is unfolded. The main rod body 610 is configured to rotate to drive the upper supporting rod 500 to rotate in the same plane relative to the connecting base 400 to fold or unfold the folding assembly. In other words, a user can complete the folding and unfolding of the folding support by rotating the main rod body 610, so that the operations of folding and unfolding the folding support are simplified, and use experience of the folding bed is improved.

When the folding assembly is unfolded, the upper supporting rod 500 and the main rod body 610 are unfolded away from each other, the upper supporting rod 500 and the main rod body 610 are both unfolded outwardly to abut against the connecting base 400, the upper supporting rod 500 as a whole obliquely extends upward in a direction away from the supporting crossbar 300, the main rod body 610 is positioned adjacent to a side of the connecting base 400 facing away from the supporting crossbar 300, the main rod body 610 as a whole obliquely extends downward in a direction away from the supporting crossbar 300, the two bed cloth supporting rods 200 move away from each other, and the bed cloth main body 100 is unfolded. In addition, the main rod body 610 is locked and engaged with the connecting base 400 to limit a rotation of the main rod body 610 and the upper supporting rod 500, so that the folding assembly is maintained in an unfolded state.

When the folding assembly is folded, the upper supporting rod 500 and the main rod body 610 are folded toward each other, the upper supporting rod 500 and the main rod body 610 are both folded inwardly to be positioned adjacent to an upper side of the supporting crossbar 300, the two bed cloth supporting rods 200 move toward each other, and the bed cloth main body 100 is folded.

The main rod body 610 can serve as a "supporting member" for supporting the bed cloth main body 100 and the bed cloth supporting rod 200 and an "operating member" for folding and unfolding the folding support, thereby simplifying the operations of folding and unfolding the folding support while simplifying the structure of the folding support, eliminating unnecessary cumbersome operation steps, and making the use of the folding support and the folding bed more labor-saving and convenient.

It should be noted that when the folding bed is folded, the bed cloth main body 100 and the bed cloth supporting rods 200 may be kept being connected to the folding supports or may be separated from the folding supports. In the case where the bed cloth main body 100 and the bed cloth supporting rods 200 are kept being connected to the folding supports after the folding bed is folded, the plurality of folding supports are arranged at intervals, the bed cloth main body 100 and the bed cloth supporting rods 200 are received above the supporting crossbar 300, and the folding bed is in a long flat shape. In the case where the bed cloth main body 100 and the bed cloth supporting rods 200 are separated from the folding supports after the folding bed is folded, the bed cloth main body 100 and the bed cloth supporting rods 200 can be stored separately from the plurality of folding supports.

Further, the connecting base 400 includes a first connecting portion 410 and a second connecting portion 420, the first connecting portion 410 is configured to be connected to the supporting crossbar 300, the second connecting portion 420 is configured to be connected to the upper supporting rod 500, the first connecting portion 410 extends in a horizontal direction, the second connecting portion 420 extends in a vertical direction, the first connecting portion 410 and the second connecting portion 420 are arranged perpendicular to each other, and the second connecting portion 420 is located above the first connecting portion 410, so that the connecting base 400 is in an L-shape. The second connecting portion 420 includes a main support wall 421 and two side support walls 422 located respectively on two sides of the main support wall 421. The hinge groove 430 is defined by the main support wall 421 and the two side support walls 422. The open end of the hinge groove 430 is provided with a hinge shaft. The hinge end of the upper supporting rod 500 is rotatably connected to the open end of the hinge groove 430 through the hinge shaft. When the folding assembly is unfolded, the upper supporting rod 500 is rotated to a maximum unfolded position. The upper supporting rod 500 as a whole obliquely extends upward in the direction away from the supporting crossbar 300. The upper supporting rod 500 is configured to abut against a top end of the main support wall 421. The main support wall 421 limits a further rotation of the upper supporting rod 500 and supports the upper supporting rod 500, thereby improving the supporting stability of the upper supporting rod 500 for the bed cloth main body 100 and the bed cloth supporting rod 200.

Further, the main rod body 610 includes a bottom rod 611 and two side rods 612. Bottom ends of the two side rods 612 are integrally connected to two end portions of the bottom rod 611, respectively. A top end of each of the two side rods 612 is rotatably connected to a middle portion of the upper supporting rod 500, and the two side rods 612 are arranged inclined relative to the bottom rod 611, so that the main rod body 610 is in a triangular shape. When the main rod body 610 is supported on the placement plane, the triangular structure can improve the supporting stability of the main rod body 610 and prevent the folding bed from shaking during use.

Each of the two side rods 612 includes a supporting segment adjacent to the bottom rod 611 and a connecting segment away from the bottom rod 611. The supporting segment is arranged inclined relative to the connecting segment. An angle is formed between the supporting segment and the connecting segment. The angle ranges from 165° to 175°. Based on the above configuration, when the folding assembly is unfolded, the connecting segment is positioned adjacent to an end surface of the connecting base 400 facing away from the supporting crossbar 300, and the supporting segment obliquely extends downward in a direction away from the supporting crossbar 300.

Further, a locking member 700 is movably arranged on the main rod body 610. The locking member 700 includes a locking push button 710 and a locking pin 720 arranged on the locking push button 710. A locking portion 450 is arranged on the side of the connecting base 400 facing away from the supporting crossbar 300. A locking cavity having an opening facing upward in the vertical direction is defined by the locking portion 450 and the connecting base 400. The locking push button 710 is configured to be pushed to drive the locking pin 720 to slide between a locked position and an unlocked position. When the locking push button 710 and the locking pin 720 are in the locked position, the locking pin 720 is embedded in the locking cavity, the locking pin 720 is engaged with the locking portion 450 to lock the main rod body 610, and the main rod body 610 is limited from rotating relative to the connecting base 400, thereby preventing the main rod body 610 from rotating and causing the folding support to fold. When the locking push button 710 and the locking pin 720 are in the unlocked position, the locking pin 720 exits the locking cavity, and the locking pin 720 is disengaged from the locking portion 450 to unlock the main rod body 610, so that the main rod body 610 can rotate freely relative to the connecting base 400.

The locking pin 720 and the locking portion 450 each have a locking plane. When the locking pin 720 is engaged with the locking portion 450, the two locking planes abut against each other to lock the main rod body 610 and limit the main rod body 610 from rotating relative to the connecting base 400.

An elastic member 800 is further arranged between the locking push button 710 and the main rod body 610. A first end of the elastic member 800 abuts against the main rod body 610. A second end of the elastic member 800 abuts against the locking push button 710. The elastic member 800 is configured to apply a force to the locking push button 710 to push the locking push button 710 to move toward the locked position. When no external force is applied to the locking push button 710 or an external force applied to the locking push button 710 does not exceed a preset value, the locking push button 710 and the locking pin 720 are maintained in the locked position, and the locking pin 720 has a tendency to maintain being locked and engaged with the locking portion 450. Alternatively, the elastic member 800 may push the locking push button 710 from the unlocked position to the locked position after an external force applied to the locking push button 710 is released. The elastic member 800 may be made of any elastic energy storage material, including, but not limited to, elastic rubber, spring, etc.

The locking pin 720 has a curved guide surface 721. The locking portion 450 has an inclined guide surface 451. During rotation of the main rod body 610 to unfold the folding support, the locking pin 720 comes into contact with the locking portion 450, and the curved guide surface 721 of the locking pin 720 abuts against the inclined guide surface 451 of the locking portion 450. The locking pin 720 is configured to drive the locking push button 710 to slide along the inclined guide surface 451. During the sliding process, the locking pin 720 and the locking push button 710 move from the locked position to the unlocked position and compress the elastic member 800. When the main rod body 610 is rotated to a maximum unfolded position, the locking pin 720 slides to above the locking cavity along the inclined guide surface 451, the curved guide surface 721 of the locking pin 720 is separated from the inclined guide surface 451 of the locking portion 450, the locking pin 720 is pushed into the locking cavity by the elastic member 800, and the locking plane of the locking pin 720 and the locking plane of the locking portion 450 abut against each other to reliably lock the main rod body 610. In other words, in the process of unfolding the folding assembly, the user does not need to push the locking push button 710 to allow the locking pin 720 to be embedded in the locking cavity and engaged with the locking portion 450, and when the main rod body 610 is rotated to the maximum unfolded position, the locking pin 720 can be automatically embedded in the locking cavity and engaged with the locking portion 450 to lock the main rod body 610.

When the folding support is unfolded, the two upper supporting rods 500 obliquely extend upward in a direction away from the supporting crossbar 300, and the two upper supporting rods 500 and the supporting crossbar 300 form a trapezoidal structure with a wide top side and a narrow bottom side. When the folding support is unfolded, the connecting segment of each of the two main rod bodies 610 is positioned adjacent to the end surface of the respective connecting base 400 facing away from the supporting crossbar 300, the supporting segments of the two main rod bodies 610 obliquely extend downward in a direction facing away from the supporting crossbar 300, and the two main rod bodies 610 and the supporting crossbar 300 form a trapezoidal structure with a narrow top side and a wide bottom side. Compared with a rectangular structure or structures of other shapes, the trapezoidal structure can better disperse stress and reduce local stress concentration when bearing a load, thereby improving the supporting stability for the bed cloth main body 100 and the bed cloth supporting rod 200, and preventing the folding bed from shaking or overturning.

Embodiment 2

Figure 12:
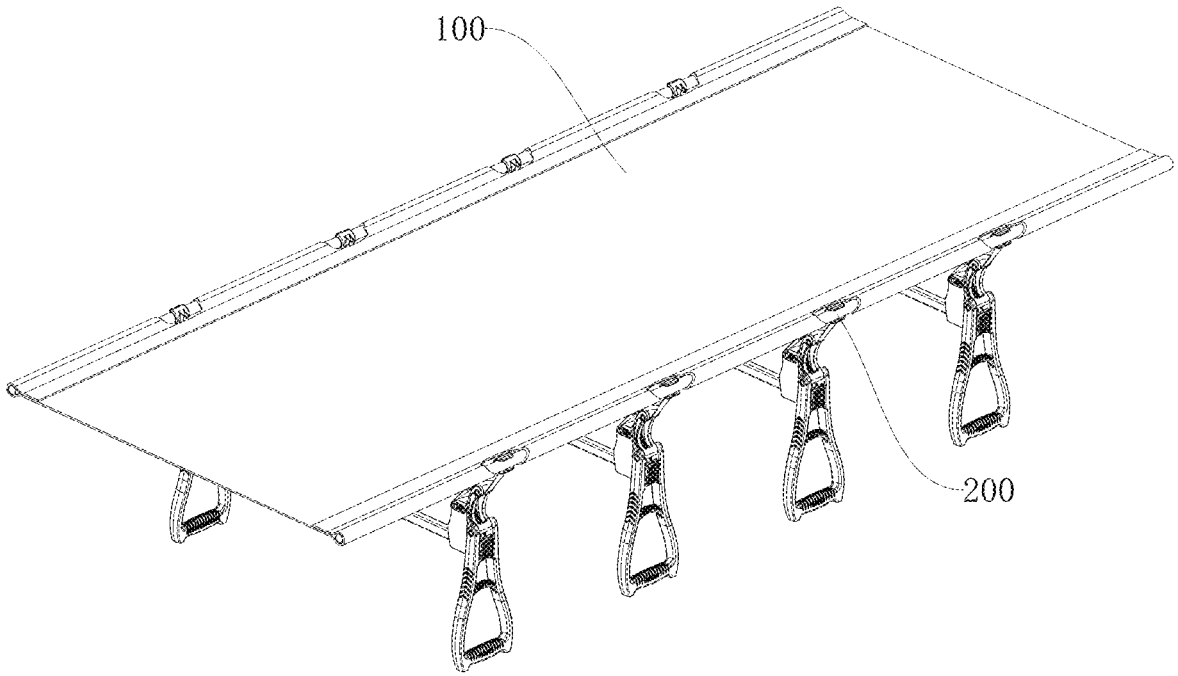
FIG. 12 is a three-dimensional schematic structural diagram of a folding bed according to Embodiment 2 of the present disclosure.
Figure 13:
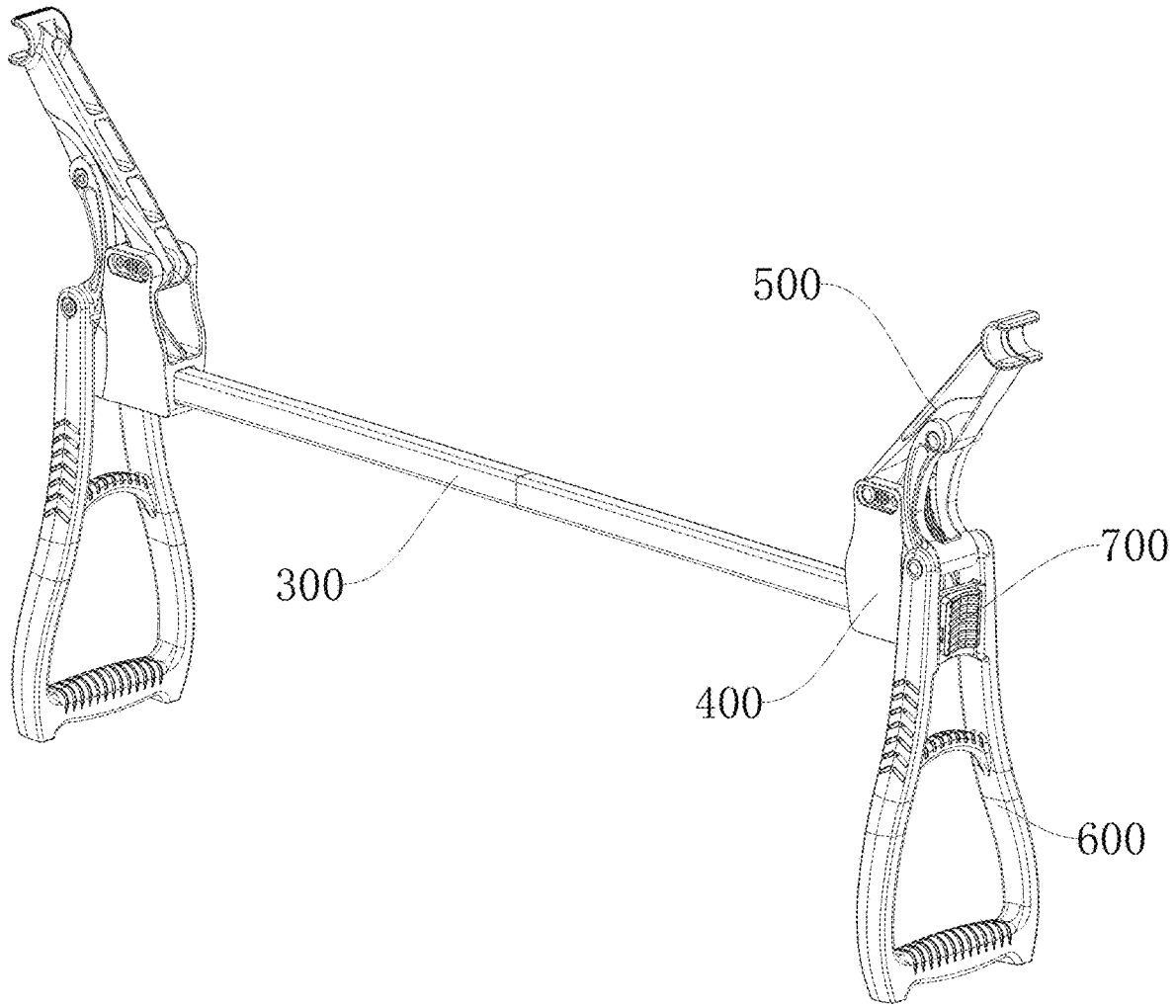
FIG. 13 is a three-dimensional schematic structural diagram of a folding support in an unfolded state according to Embodiment 2 of the present disclosure.
Figure 14:
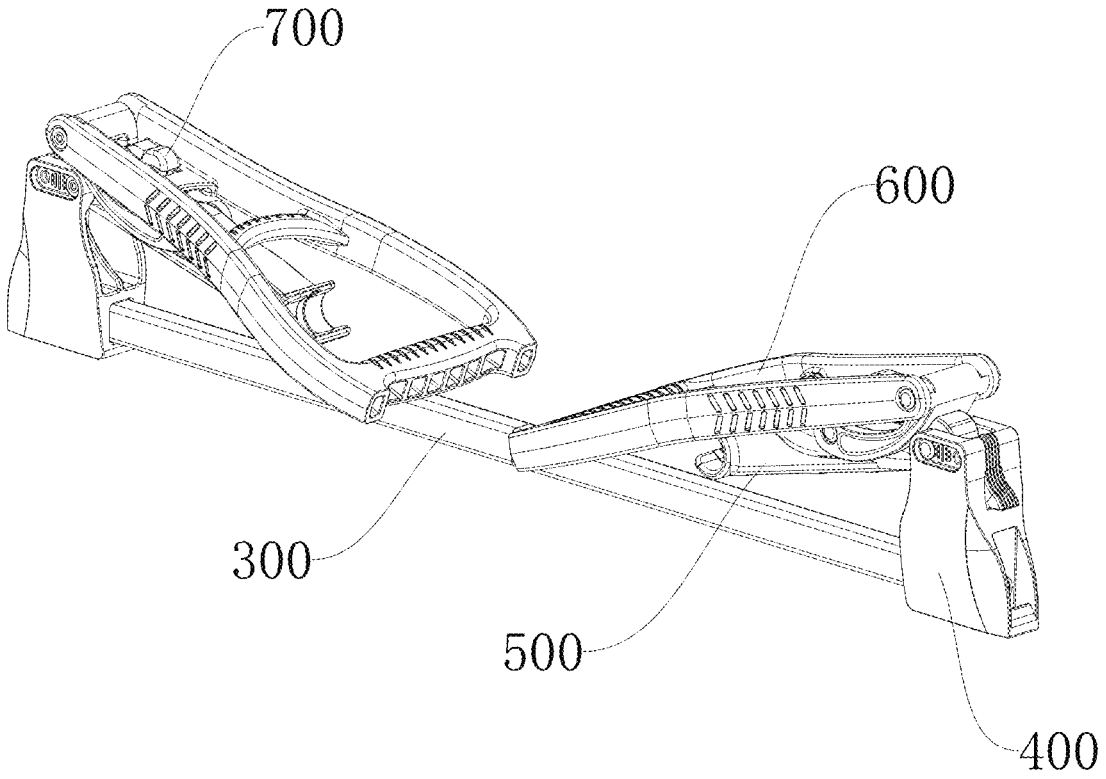
FIG. 14 is a three-dimensional schematic structural diagram of a folding support in a folded state according to Embodiment 2 of the present disclosure.
Figure 15:
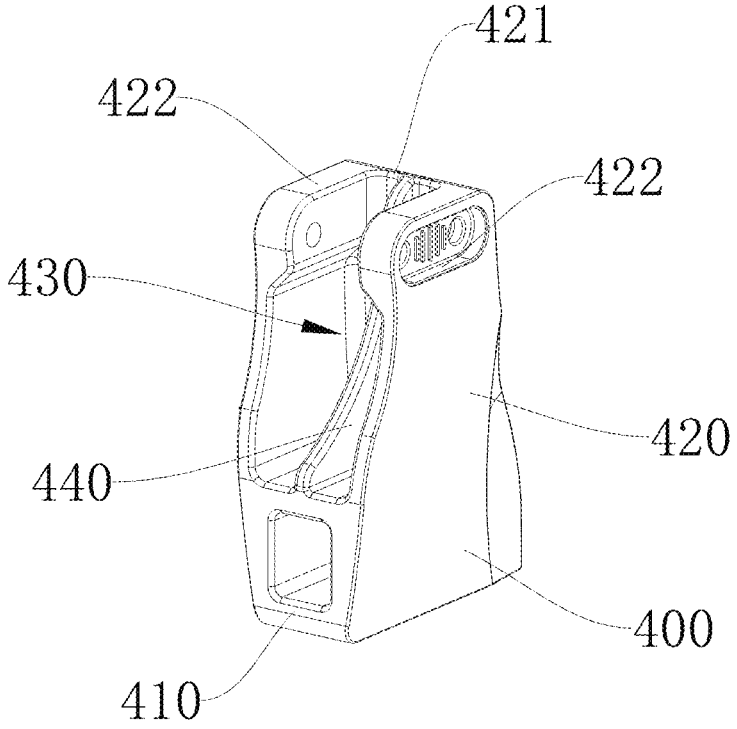
FIG. 15 is a three-dimensional schematic structural diagram of a connecting base according to Embodiment 2 of the present disclosure.
Figure 16:
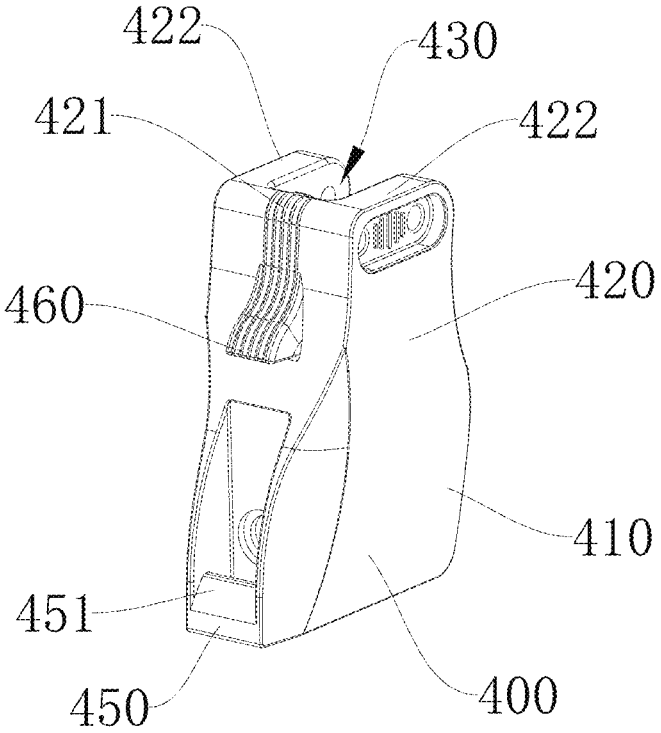
FIG. 16 is a three-dimensional schematic structural diagram of a connecting base according to Embodiment 2 of the present disclosure when viewed from another angle.
Figure 17:
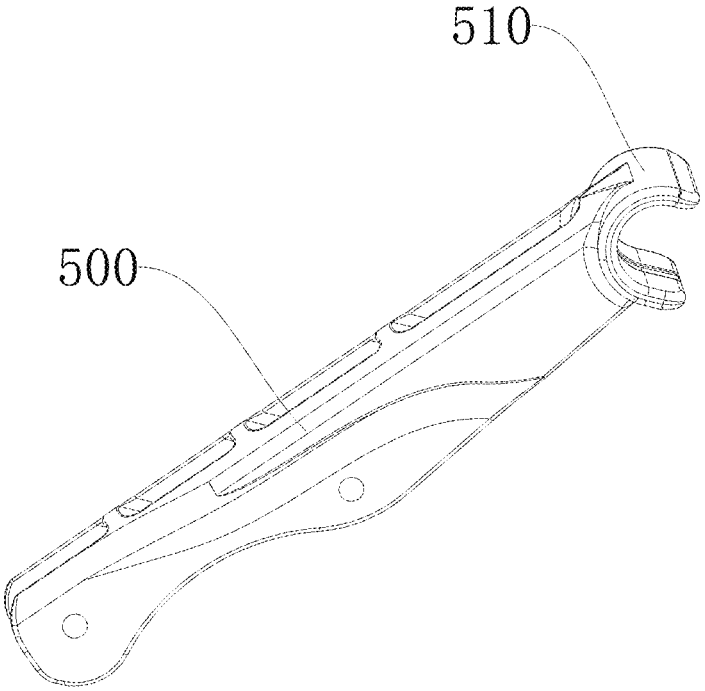
FIG. 17 is a three-dimensional schematic structural diagram of an upper supporting rod according to Embodiment 2 of the present disclosure.
Figure 18:
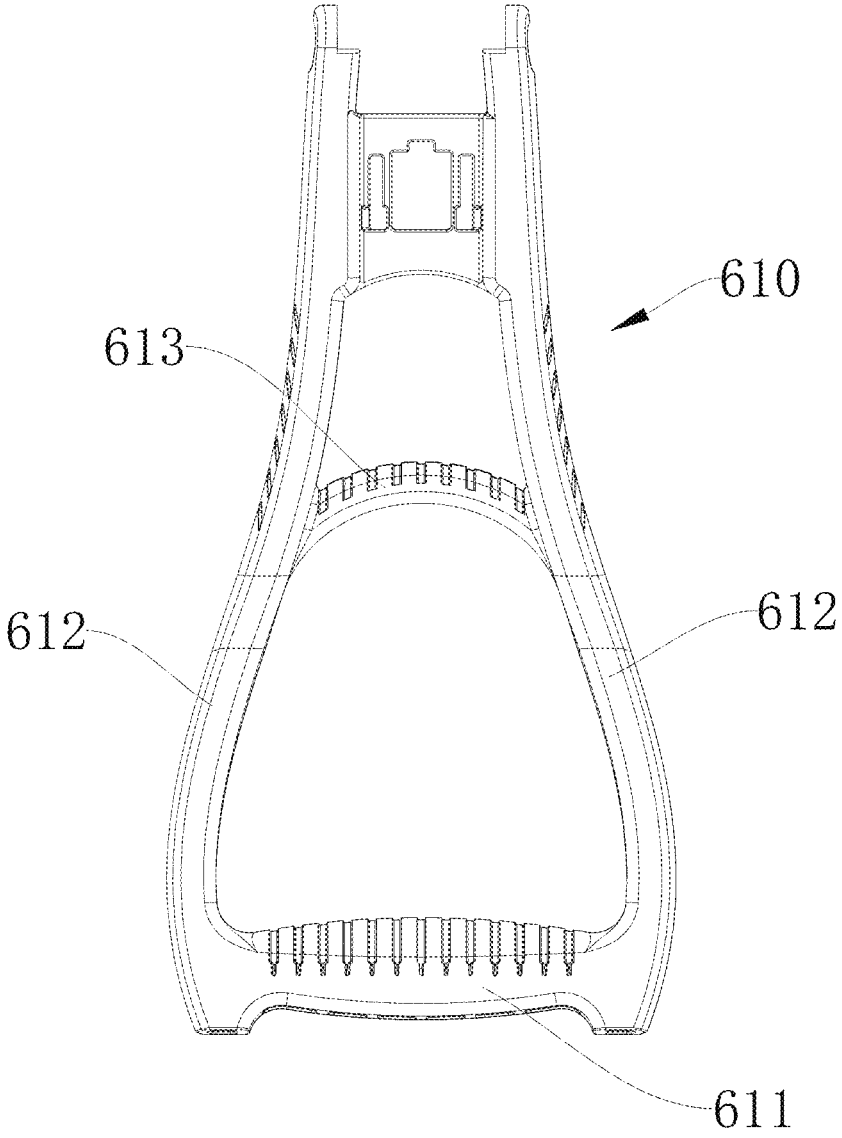
FIG. 18 is a schematic structural diagram of a main rod body according to Embodiment 2 of the present disclosure.
Figure 19:
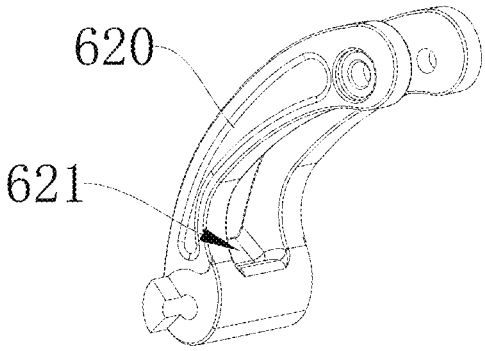
FIG. 19 is a schematic structural diagram of an extension rod body according to Embodiment 2 of the present disclosure.
Figure 20:
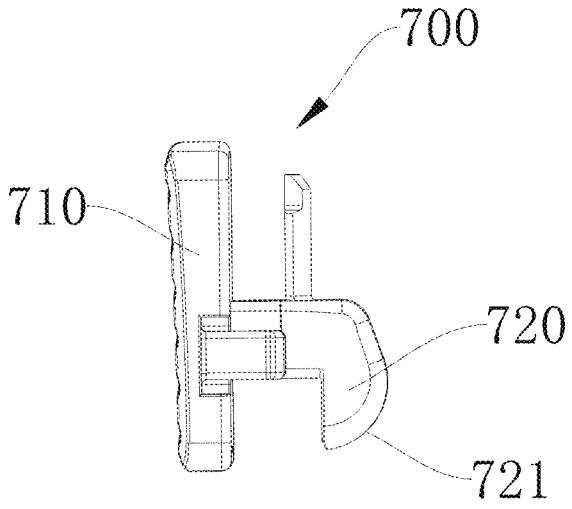
FIG. 20 is a schematic structural diagram of a locking member according to Embodiment 2 of the present disclosure.
Figure 21:
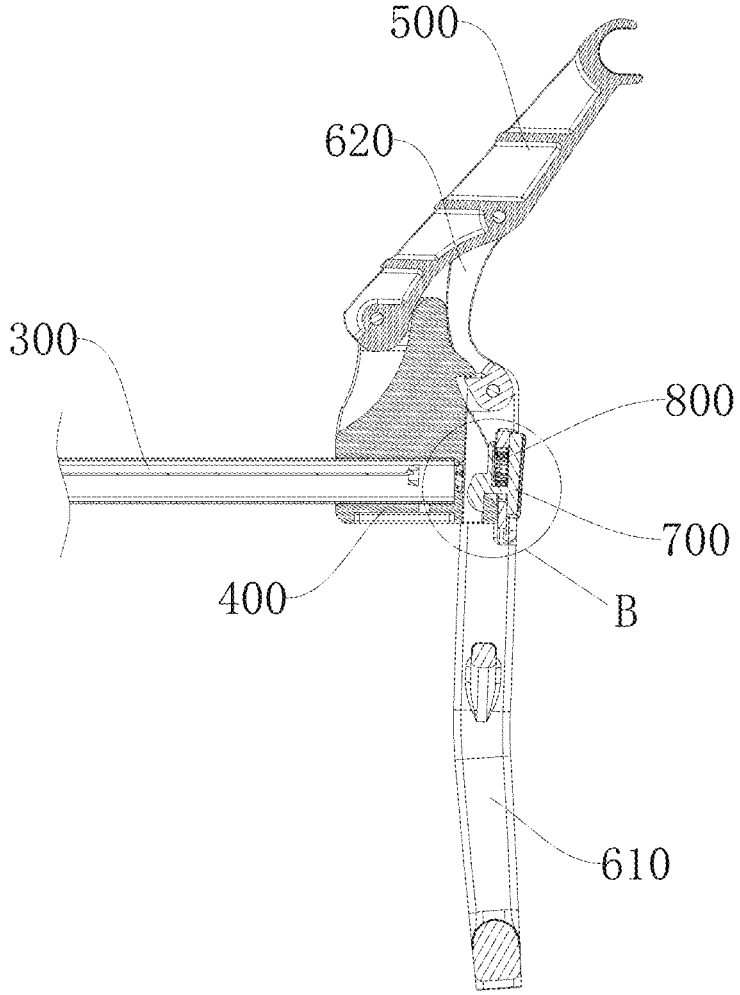
FIG. 21 is a schematic cross-sectional view of a folding assembly in an unfolded state according to Embodiment 2 of the present disclosure.
Figure 22:
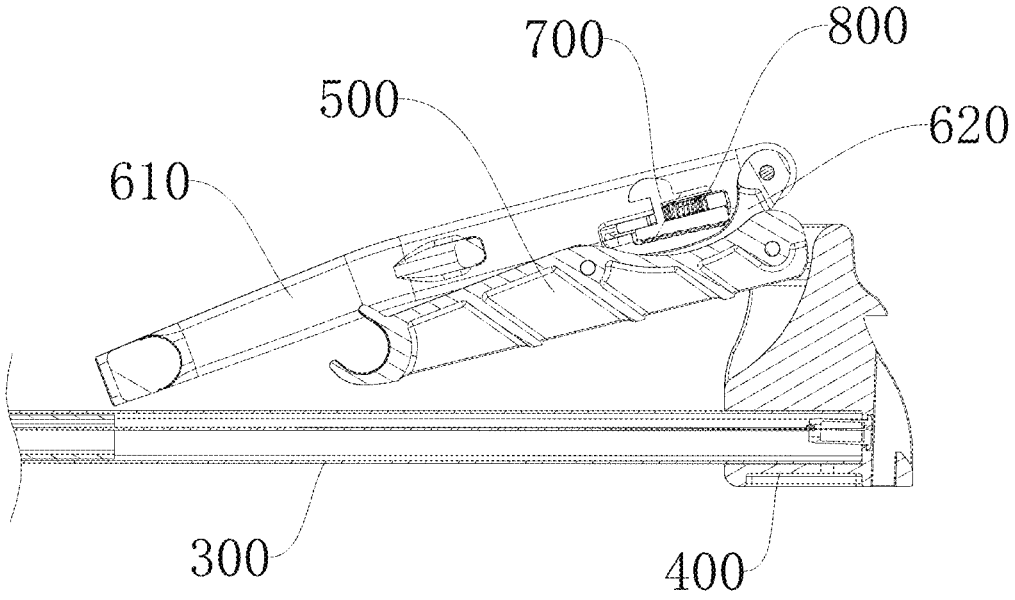
FIG. 22 is a schematic cross-sectional view of a folding assembly in a folded state according to Embodiment 2 of the present disclosure.
Figure 23:
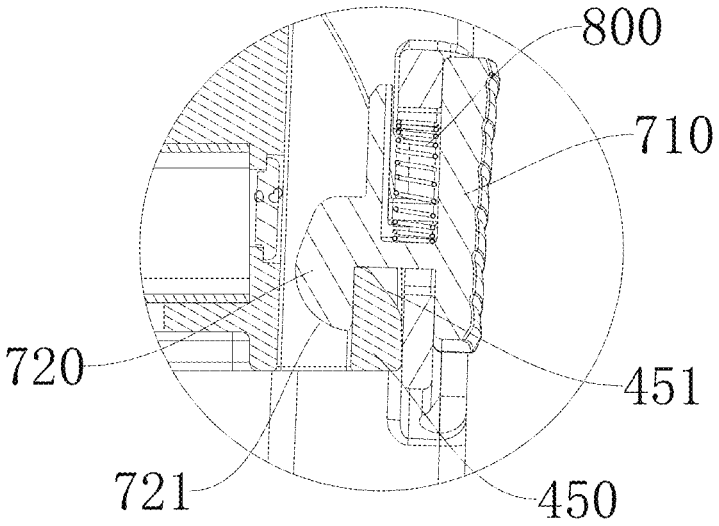
FIG. 23 is a schematic partially enlarged view of part A in FIG. 21.

As shown in FIG. 12 to FIG. 23, this embodiment is different from Embodiment 1 in the structure of the lower supporting rod 600. In this embodiment, the lower supporting rod 600 includes a main rod body 610 and an extension rod body 620.

Each of the plurality of folding supports includes a supporting crossbar 300 and a folding assembly arranged at each of two ends of the supporting crossbar 300. The folding assembly includes a connecting base 400, an upper supporting rod 500, and a lower supporting rod 600. The connecting base 400 is fixedly connected to an end portion of the supporting crossbar 300. The connecting base 400 is provided with a hinge groove 430. An opening of the hinge groove 430 is located on an end surface of the connecting base 400 adjacent to the supporting crossbar 300. A bottom end of the hinge groove 430 is configured as a closed end. A top end of the hinge groove 430 is configured as an open end in communication with an outside. The upper supporting rod 500 includes a hinge end and a mounting end. The hinge end of the upper supporting rod 500 is configured to be rotatably connected to the open end of the hinge groove 430. The mounting end of the upper supporting rod 500 is configured to be detachably connected to the respective bed cloth supporting rod 200. The mounting end is provided with a bracket 510. The bracket 510 is made of elastic plastic and is provided with an opening. The bed cloth supporting rod 200 is configured to pass through the opening and be detachably engaged in the bracket 510. The lower supporting rod 600 includes an extension rod body 620 and a main rod body 610. A first end of the extension rod body 620 is rotatably connected to a middle portion of the upper supporting rod 500. A second end of the extension rod body 620 is rotatably connected to a first end of the main rod body 610. A second end of the main rod body 610 is configured to be supported on the placement plane when the folding assembly is unfolded. The main rod body 610 is configured to rotate to drive the upper supporting rod 500 and the extension rod body 620 to rotate in the same plane relative to the connecting base 400 to fold or unfold the folding assembly. In other words, a user can complete the folding and unfolding of the folding support by rotating the main rod body 610, so that the operations of folding and unfolding the folding support are simplified, and use experience of the folding bed is improved.

When the folding assembly is folded, the upper supporting rod 500, the extension rod body 620, and the main rod body 610 are folded toward one another, the upper supporting rod 500, the extension rod body 620, and the main rod body 610 are folded inwardly to be positioned adjacent to an upper side of the supporting crossbar 300, the two bed cloth supporting rods 200 move toward each other, and the bed cloth main body 100 is folded.

When the folding assembly is unfolded, the upper supporting rod 500, the extension rod body 620, and the main rod body 610 are unfolded away from one another, the upper supporting rod 500, the extension rod body 620, and the main rod body 610 are all unfolded outwardly to abut against the connecting base 400, the upper supporting rod 500 as a whole obliquely extends upward in a direction away from the supporting crossbar 300, the extension rod body 620 and the main rod body 610 are positioned adjacent to a side of the connecting base 400 facing away from the supporting crossbar 300, the main rod body 610 as a whole extends obliquely downward in a direction away from the supporting crossbar 300, the two bed cloth supporting rods 200 move away from each other, and the bed cloth main body 100 is unfolded. In addition, the main rod body 610 is locked and engaged with the connecting base 400 to limit a rotation of the main rod body 610, the extension rod body 620, and the upper supporting rod 500, so that the folding assembly is maintained in an unfolded state.

The arrangement of the extension rod body 620 increases the distance from a top end of the main rod body 610 to the middle portion of the upper supporting rod 500. When the folding assembly is unfolded, the upper supporting rod 500, the extension rod body 620, and the main rod body 610 are respectively rotated to their maximum unfolded positions, and the mounting end of the upper supporting rod 500 is at a higher height. In other words, the arrangement of the extension rod body 620 can increase the distance from the bed cloth main body 100 and the bed cloth supporting rod 200 to the placement plane, thereby solving the problem that the position of the bed cloth main body 100 and the bed cloth supporting rod 200 is too low and the user is infested by ground moisture, ground dust, and insects and ants when using the folding bed to rest.

The extension rod body 620 may preferably be configured as an arc-shaped structure, and an arc-shaped curved surface is provided on the side of the connecting base 400 facing away from the supporting crossbar 300. When the extension rod body 620 is rotated to the maximum unfolded position, the extension rod body 620 of the arc-shaped structure can abut against the arc-shaped curved surface on the connecting base 400, and the connecting base 400 can support the extension rod body 620, thereby further improving the structural stability of the folding support.

A limiting groove 621 is provided on the extension rod body 620, a limiting portion 460 is provided on the arc-shaped curved surface of the connecting base 400, and the limiting portion 460 is configured to be engaged with the limiting groove 621. When the extension rod body 620 is rotated to the maximum unfolded position and abuts against the arc-shaped curved surface of the connecting base 400, the limiting portion 460 is embedded in the limiting groove 621, and the limiting portion 460 and the limiting groove 621 abut against each other to limit the extension rod body 620 from driving the main rod body 610 to move upward in the vertical direction. Because the opening of the locking cavity defined by the locking portion 450 and the connecting base 400 faces upward in the vertical direction, the locking pin 720 will exit the locking cavity and be disengaged from the locking portion 450 if the extension rod body 620 drives the main rod body 610 to move upward in the vertical direction, so that the main rod body 610 is unlocked, and the main rod body 610 can drive the extension rod body 620 and the upper supporting rod 500 to rotate to fold the folding support. The arrangement of the limiting groove 621 on the extension rod body 620 and the limiting portion 460 on the connecting base 400 can further improve the locking effect between the locking pin 720 and the locking portion 450, to prevent the main rod body 610 in the locked state from being unintentionally unlocked to fold the folding support.

Different from Embodiment 1, in this embodiment, a reinforcing rib 440 is further arranged in the hinge groove 430. The reinforcing rib 440 is connected to a top wall of the first connecting portion 410 and an inner wall of the main support wall 421. When the folding assembly is unfolded, the upper supporting rod 500 is rotated to a maximum unfolded position. The upper supporting rod 500 as a whole obliquely extends upward in the direction away from the supporting crossbar 300. The upper supporting rod 500 is configured to abut against the reinforcing rib 440. The reinforcing rib 440 limits a further rotation of the upper supporting rod 500 and supports the upper supporting rod 500, thereby improving the supporting stability of the upper supporting rod 500 for the bed cloth main body 100 and the bed cloth supporting rod 200.

Different from Embodiment 1, in this embodiment, a gripping crossbar 613 is arranged between the two side rods 612 of the main rod body 610. The gripping crossbar 613 is configured to be gripped as a "handle" for operating and rotating the main rod body 610, making it convenient for the user to operate and rotate the main rod body 610.

The basic principles, main features, and advantages of the present disclosure have been described above. Those skilled in the art should understand that the present disclosure is not limited to the above-mentioned embodiments. The descriptions of the embodiments and the specification are only for illustrating the principles of the present disclosure. Various changes and improvements may be made to the present disclosure without departing from the spirit and scope of the present disclosure, and such changes and improvements all fall within the scope of protection claimed by the present disclosure. The scope of protection claimed by the present disclosure is defined by the appended claims and equivalents thereof.

What is claimed is:

1. A folding support, comprising a supporting crossbar and a folding assembly arranged at each of two ends of the supporting crossbar, wherein the folding assembly comprises a connecting base, an upper supporting rod, and a lower supporting rod, the connecting base is fixedly mounted at an end portion of the supporting crossbar, the upper supporting rod is rotatably connected to the connecting base, the lower supporting rod is rotatably connected to the upper supporting rod, and the upper supporting rod and the lower supporting rod are configured to rotate in an identical plane to implement folding and unfolding of the folding assembly;

when the folding assembly is folded, the upper supporting rod and the lower supporting rod are folded toward each other, and the upper supporting rod and the lower supporting rod are positioned adjacent to a side of the supporting crossbar; and when the folding assembly is unfolded, the upper supporting rod and the lower supporting rod are unfolded away from each other, the upper supporting rod and the lower supporting rod abut against the connecting base, and the lower supporting rod is locked and engaged with the connecting base to limit a rotation of the upper supporting rod and the lower supporting rod to allow the folding assembly to be maintained in an unfolded state.

2. The folding support according to claim 1, wherein the upper supporting rod comprises a hinge end and a mounting end, the hinge end is configured to be rotatably connected to the connecting base, the mounting end is configured to be detachably connected to a bed cloth supporting rod, the lower supporting rod comprises a main rod body, and an end of the main rod body is rotatably connected to a middle portion of the upper supporting rod; or the upper supporting rod comprises a hinge end and a mounting end, the hinge end is configured to be rotatably connected to the connecting base, the mounting end is configured to be detachably connected to a bed cloth supporting rod, the lower supporting rod comprises an extension rod body and a main rod body, a first end of the extension rod body is rotatably connected to a middle portion of the upper supporting rod, and a second end of the extension rod body is rotatably connected to an end portion of the main rod body.

3. The folding support according to claim 2, wherein the connecting base is provided with a hinge groove, an opening of the hinge groove is located on an end surface of the connecting base adjacent to the supporting crossbar, a bottom end of the hinge groove is configured as a closed end, a top end of the hinge groove is configured as an open end in communication with an outside, and the hinge end of the upper supporting rod is rotatably connected to the open end of the hinge groove.

4. The folding support according to claim 3, wherein the connecting base comprises a first connecting portion and a second connecting portion, the first connecting portion is configured to be connected to the supporting crossbar, the second connecting portion is configured to be connected to the upper supporting rod, the first connecting portion extends in a horizontal direction, the second connecting portion extends in a vertical direction, the second connecting portion is perpendicularly arranged above the first connecting portion, the connecting base is in an L-shape, and the hinge groove is arranged on the second connecting portion.

5. The folding support according to claim 4, wherein the second connecting portion comprises a main support wall and two side support walls located respectively on two sides of the main support wall, the hinge groove is defined by the main support wall and the two side support walls, and when the folding assembly is unfolded, the upper supporting rod is configured to abut against a top end of the main support wall, and the main support wall limits a further rotation of the upper supporting rod and supports the upper supporting rod.

6. The folding support according to claim 4, wherein the second connecting portion comprises a main support wall and two side support walls located respectively on two sides of the main support wall, the hinge groove is defined by the main support wall and the two side support walls, a reinforcing rib is arranged in the hinge groove, and when the folding assembly is unfolded, the upper supporting rod is configured to abut against the reinforcing rib, and the reinforcing rib limits a further rotation of the upper supporting rod and supports the upper supporting rod.

7. A folding bed, comprising the folding support according to claim 3.

8. A folding bed, comprising the folding support according to claim 4.

9. A folding bed, comprising the folding support according to claim 5.

10. A folding bed, comprising the folding support according to claim 6.

11. The folding support according to claim 2, wherein a locking push button is movably arranged on the main rod body, a locking pin is arranged on the locking push button, a locking portion is arranged on the connecting base, a locking cavity is defined by the locking portion and the connecting base, and the locking push button is configured to drive the locking pin to slide into the locking cavity to allow the locking pin to be engaged with the locking portion to limit a rotation of the main rod body.

12. The folding support according to claim 11, wherein an elastic member is further arranged between the locking push button and the main rod body, the elastic member is configured to apply a force to the locking push button to allow the locking pin to be embedded in the locking cavity, and the locking pin has a tendency to maintain being locked and engaged with the locking portion.

13. The folding support according to claim 11, wherein the locking pin has a curved guide surface, the locking portion has an inclined guide surface, and the curved guide surface is configured to come into contact with the inclined guide surface to guide the locking pin to slide into the locking cavity.

14. The folding support according to claim 11, wherein a limiting portion is arranged on the connecting base, a limiting groove is provided on the extension rod body, and when the folding assembly is unfolded, the limiting portion abuts against the limiting groove and is engaged with the limiting groove to limit the extension rod body from driving the main rod body to move upward in a vertical direction to allow the locking pin to be disengaged from the locking portion.

15. The folding support according to claim 2, wherein the main rod body comprises a bottom rod and two side rods, bottom ends of the two side rods are integrally connected to two end portions of the bottom rod, respectively, a top end of each of the two side rods is rotatably connected to the upper supporting rod or the extension rod body, the two side rods are arranged inclined relative to the bottom rod, and the main rod body is in a triangular shape.

16. The folding support according to claim 15, wherein each of the two side rods comprises a supporting segment adjacent to the bottom rod and a connecting segment away from the bottom rod, the supporting segments are arranged inclined relative to the connecting segments, and when the folding assembly is unfolded, the supporting segments obliquely extend in a direction away from the connecting base.

17. The folding support according to claim 16, wherein an angle between the supporting segments and the connecting segments ranges from 165° to 175°.

18. The folding support according to claim 2, wherein the mounting end is provided with a bracket, and the bracket is detachably connected to the bed cloth supporting rod.

19. A folding bed, comprising the folding support according to claim 2.

20. A folding bed, comprising the folding support according to claim 1.

* * * * *